United States Patent [19]

Burgess et al.

[11] Patent Number: 4,906,808

[45] Date of Patent: Mar. 6, 1990

[54] TEASE-FREE SWITCH

[75] Inventors: James P. Burgess, Camarillo, Calif.; Thomas R. Wheeler, Lake Angelus, Mich.

[73] Assignee: Electro-Mechanical Products, Rochester, Mich.

[21] Appl. No.: 229,274

[22] Filed: Aug. 8, 1988

[51] Int. Cl.[4] ..... H01H 13/58

[52] U.S. Cl. ..... 200/527; 200/536

[58] Field of Search ..... 200/527, 528, 529, 526, 200/523, 536

[56] References Cited

U.S. PATENT DOCUMENTS

| | | | |
|---|---|---|---|
| 3,204,067 | 8/1965 | Brown | 200/527 |
| 3,226,991 | 1/1966 | Hartsock | 200/529 X |
| 3,883,710 | 5/1975 | Hanssen et al. | 200/527 |
| 4,476,354 | 10/1984 | Bienwald | 200/527 |

*Primary Examiner*—Renee S. Luebke

*Attorney, Agent, or Firm*—Krass and Young

[57] ABSTRACT

A tease-free switch includes a plurality of electrical terminals of planar configuration disposed in spaced apart relationship upon an electrically insulating base as well as a generally planar contact plate including at least two electrical contact regions thereupon. The plate is engaged by a push-button actuated stepping mechanism so as to be alternately rotated between a position where contact between particular of the terminals is alternately established and terminated. The switch is configured so that the contact plate is constantly biased into contact with the terminals and/or the insulating surface upon which they are disposed. In this manner partial activation of the switch will not alter the condition of the electrical contacts.

2 Claims, 2 Drawing Sheets

TEASE-FREE SWITCH

FIELD OF THE INVENTION

This invention relates generally to switches and more particularly to electrical switches. The invention relates most specifically to a tease-free switch of the type providing for positive actuation between various switched states.

BACKGROUND OF THE INVENTION

Switches are the most commonly employed element in virtually all electronic circuits. In general, a switch may be characterized as a device which selects or terminates a current path. Switches may comprise large electromechanical circuit breakers adapted to handle thousands of amperes or they may comprise microminiature solid state devices such as the switches which make up the logic gates of computing circuitry. In general, the present application is directed to a mechanical switch of the type adapted to switch moderate current loads in a variety of applications. In particular, the switches of the present invention are push button type switches and have broad utility in the fabrication of many consumer products such as vehicles, tools, and electrical appliances.

Switches of this type are well known in the art and examples thereof may be found in U.S. Pat. Nos. 4,308,440; 4,225,764; 4,175,222; 4,288,670; 4,345,128; 4,317,015, the disclosures of which are incorporated herein by reference. Disclosed in the foregoing patents are small, relatively simple push-button switches of the type adapted to sequentially open and close a circuit or to sequentially switch power between two alternate circuits. In addition to the particular switch designs shown in the foregoing patents, there are known to those of skill in the art a variety of other configurations adapted for similar function.

A problem with all of the switches of this type found in the prior art is that they are prone to teasing. As used in reference to switching and in the context of the present disclosure, "teasing" is understood to refer to actuation of a switch from one state to another by slight manipulation of the actuator button of a pushbutton switch. By teasing a switch, a closed circuit may be opened or an opened circuit may be closed without fully actuating the switch to the other position. This lack of a positive and complete switch action can be a source of annoyance and in some instances a hazard to the switched equipment and possibly the operator. For example, in vehicular applications, push-button switches are frequently used to alternately activate and deactivate warning lights, engine control systems, climate controls and the like. Road vibration, or jostling by the operator can "tease " prior art switches thereby causing inadvertent brief periods of activation or deactivation of the associated control system. Obviously such transient switching effects are at best a nuisance and in some instances a serious hazard. In light of the foregoing it will be readily understood that there is a need and desire for eliminating tease in pushbutton electrical switches.

Prior art push-button switches generally operate by moving a contact member into and out of electrical communication with a pair of terminals and minute movement of the contacts can tease the switch so as to make and break electrical communication.

The present invention provides for an improved push-button type electrical switch insofar as the switch of the present invention is positively actuatable between its switched positions without being amenable to teasing. In addition to the foregoing, the switch of the present invention is simple and inexpensive to construct and easy to use and install. These and other advantages of the present invention will be readily apparent from the drawings, discussion, description and claims which follow.

SUMMARY OF THE INVENTION

There is disclosed herein a tease-free switch comprising a housing including a base having a generally planar, electrically insulating interior surface and a first and second electrical terminal of generally planar configuration disposed in mutually spaced apart relationship upon, and or parallel planes with, the insulating surface. The switch further includes a generally planar contact plate, fabricated from an electrically conductive material and including at least two contact regions thereupon. The contact regions are operative in combination with the electrically conductive material of the plate to establish electrical communication between the first and second terminals. The switch further includes a spring disposed to urge the contact plate into contact with the electrically insulating surface and a push-button having stepping means associated therewith. The stepping means is in mechanical communication with the contact plate and operative to alternately advance the plate from a first position wherein the contact regions thereof establish electrical communication between the first and second terminals and a second position wherein the contact regions do not establish electrical communication between the first and second terminals.

The switch may be modified to allow for switching of current between alternate circuits and in such embodiment will include a third, generally planar electrical terminal disposed upon and coplanar with the insulating surface and in spaced apart relationship with the first and second terminals. In such instances the stepping means is operative to advance the contact plate from the first position wherein electrical communication is established between the first and second terminals and a second position wherein electrical contact is established between the first and third terminals.

DETAILED DESCRIPTION OF THE DRAWINGS

Figure 1:
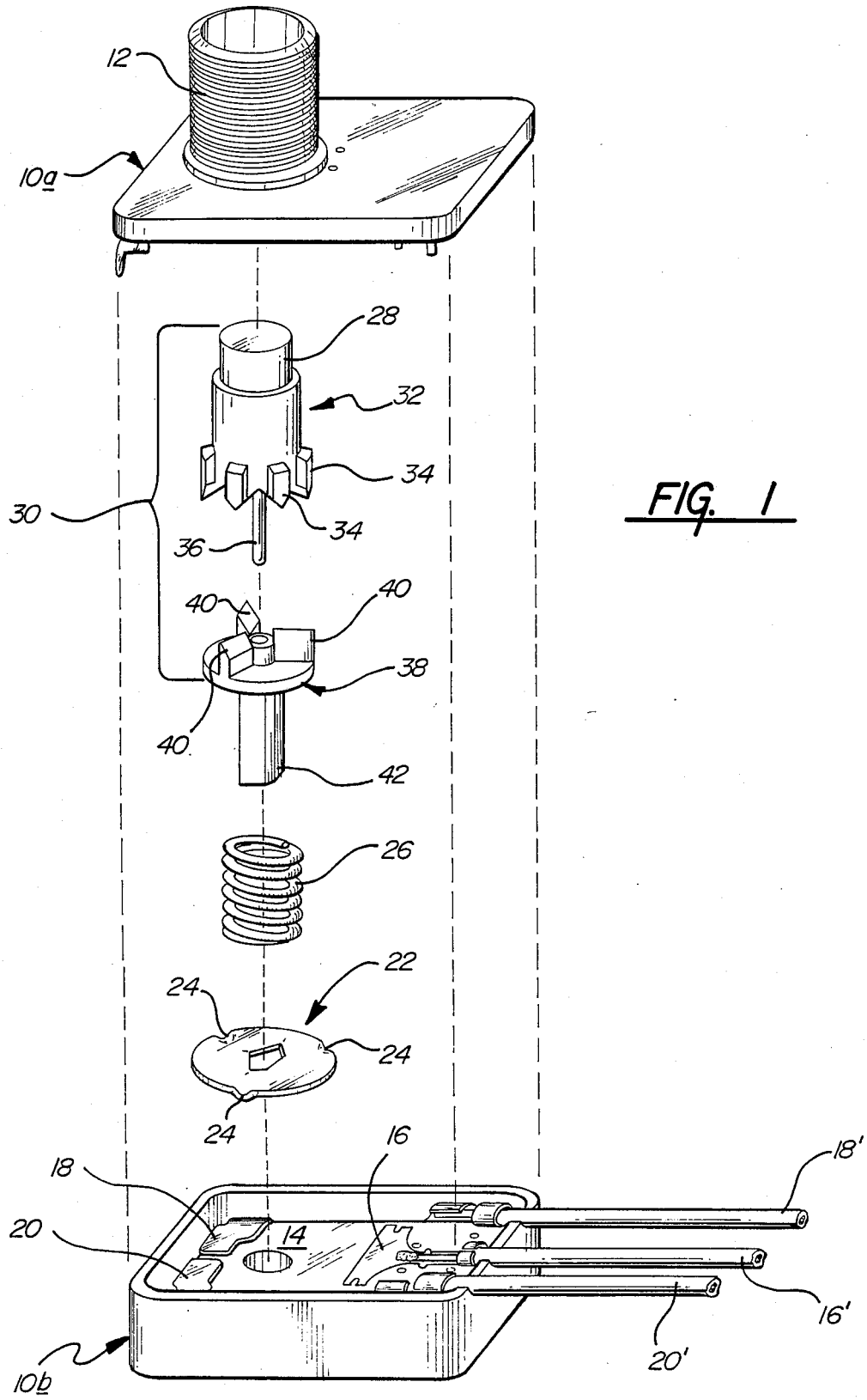
FIG. 1 is an exploded, perspective view of one particular tease-free switch structured in accord with the principles of the present invention.

Referring now to FIG. 1, there is shown an exploded perspective view of one particular embodiment of tease-free switch structured in accord with the principles of the present invention. The switch of FIG. 1 includes a housing comprised of an upper portion 10*a* and a lower portion 10*b*. The housing is adapted to retain the remaining components of the switch and may be advantageously fabricated from a variety of materials including synthetic polymeric materials, metals and the like. It is generally preferred that the switch be adapted for ready mounting in vehicles, appliances and the like and toward this end the upper portion 1O*a* of the housing depicted in FIG. 1 includes a threaded projection 12.

It is preferred that the lower portion 10*b* of the housing include a generally planar, electrically insulating interior surface indicated here by numeral 14. The surface 14 supports those portions of the switch which establish and maintain electrical contact and should be electrically insulating. In the instances where the lower portion of the housing 10*b* is fabricated from an electrically insulating material no further modification thereof will be necessary. However, if the housing 1O*b* is fabricated of metal or other such electrically conductive material, it will be necessary to provide an electrically insulating coating or member upon the interior surface 14.

As depicted in FIG. 1, the switch includes three electrical terminals 16, 18 and 20. These terminals are generally planar members and are disposed upon, and on parallel planes with, the insulating surface 14 and in mutually spaced apart relationship. In this manner, all three terminals are electrically isolated from one another. The first terminal 16 is a generally T-shaped terminal disposed at one end of the planar portion 14 of the lower housing 10*b*. The second terminal 18 and third terminal 20 are disposed at the opposite end of the planar surface 14. Each of the terminals has associated therewith an electrical lead 16', 18', 20'.

The switch further includes a contact plate 22, which in this embodiment is a disk-shaped member fabricated from an electrically conductive material such as brass, copper, steel or aluminum and disposed on parallel planes with, and superjacent the planar surface 14 and terminals 16, 18, and 20. The contact plate 22 has at least two, and in this embodiment three contact regions 24 provided thereupon. In the illustrated embodiment the contact regions 24 comprise dimples or protrusions located proximate the circumferential periphery of the contact plate 22. These contact regions 24 facilitate the establishment of electrical communication between the terminals and the contact plate 22.

The switch further includes a spring 26 disposed so as to urge the contact plate 22 into contact with the insulating surface 14. It is this urging which provides for the tease-free operation of the switch. As illustrated in the FIG. 1 embodiment, the switch further includes an actuator push-button 28 having stepping means 30 associated therewith for alternately advancing the plate 22 from one switched position to another upon pressing of the button 28.

The stepping means 30 cf this embodiment comprises a plunger 32, (in this instance mechanically connected to the actuating button 28) and including a plurality of actuator lugs 34 circumferentially disposed thereabout. The plunger 32 further includes a guide pin 36 disposed to operatively connect the plunger 32 to a camming stud 38. This camming stud 38 has a plurality of camming ramps 40 provided thereupon and disposed to be engaged by the lugs 34 of the plunger 32. The camming stud 38 further includes a depending shaft 42 configured to mechanically engage the contact plate 22 so as to effect rotation thereof. In the illustrated embodiment, the shaft 42 is of a noncircular cross section and engages the contact plate 22 via a correspondingly shaped opening in the center thereof. The shaft 42 and spring 26 are configured so that the spring 26 is retained about the shaft in interposed relationship between the remainder of the camming stud 38 and contact plate 22.

When the switch of FIG. 1 is assembled, the contact plate 22 is disposed immediately atop the insulating surface 14 and terminals 16, 18 and 20. The shaft 42 of the camming stud engages the contact plate 22 and the spring 26 biases the contact plate 22 into oontact with the insulating surface 14 and/or terminals 16, 18 and 20. The plunger 32 engages the camming stud 38, and is retained thereby via the guide pin 36. The plunger 32 is disposed within the projection 12 of the upper portion 1O*a* of the housing and the push-button 28 projects therefrom.

Figure 2:
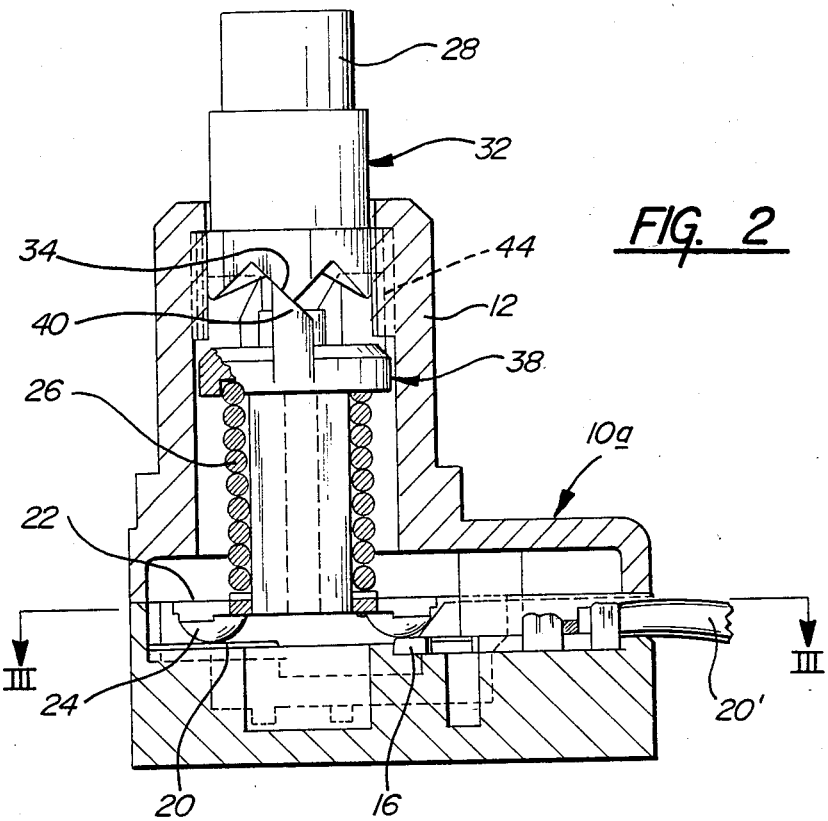
FIG. 2 is a cross-sectional view of a tease free switch generally similar to that illustrated with reference to FIG. 1.

Referring now to FIG. 2 there is shown a cross-sectional view of the switch of FIG. 1 in assembled form. FIG. 2 illustrates in particular the operation of the stepping assembly. It should be noted at this point that many variants of such mechanisms are well known to those of skill in the art and are frequently employed in the fabrication of a variety of push operated objects such as ball point pens, switches and the like and one of skill in the art could readily adapt any one of a variety of push actuated stepping mechanisms for use in the present invention, the only criteria being that such stepping mechanism be capable of rotatably advancing a member in response to actuation of a push-button. For example, one embodiment of such stepping mechanism is described in the patents incorporated herein by reference.

As shown in the FIG. 2 embodiment, the plunger portion 32 of the stepping assembly is disposed so that the lugs 34 thereof engage the camming ramps 40 of the camming stud 38. Depression of the push-button 28 causes the lugs 34 to engage, and slide along the face of the camming ramps 40 and, in the illustrated embodiment impart a clockwise rotation to the camming stud 38, which rotation effects rotation of the contact plate 22. When the actuator button 28 is fully depressed, the lugs 34 travel to the full extent to their range of motion and cease rotation of the camming stud 38. Release of the actuator button 28 allows the spring 26 to return the stud 38 and plunger 32 to their original position. In order to reposition the plunger 32 so that the lugs 34 properly engage the camming ramps 40 for a subsequent cycle, the projecting portion 12 of the upper housing 10*a* is provided with a plurality of grooves or lands, illustrated here in phantom outline at 44 and configured to impart a degree of rotation to the plunger 32 as it travels upward. As mentioned previously, such technology is well known to those of skill in the art and various alternative embodiments will be readily obvious.

Figure 3A:
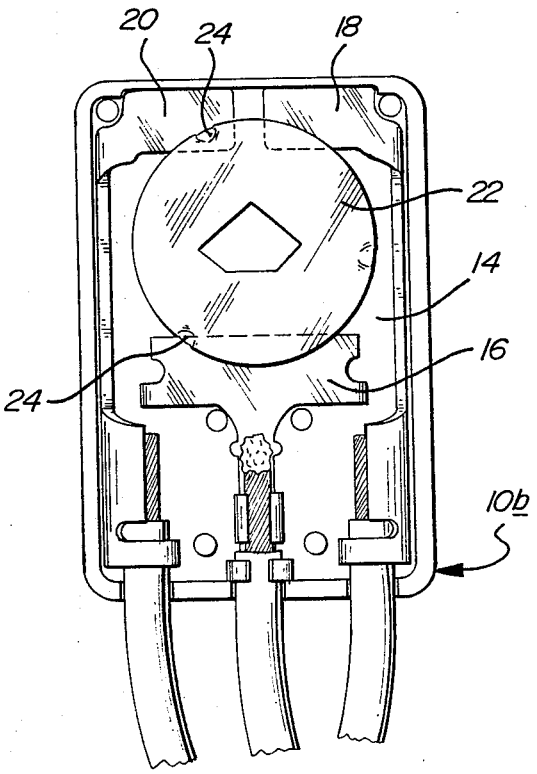
FIG. 3A is a sectional view of the switch of FIG. 2 taken along line III—III showing the contact plate in a first position.

Referring now to FIG. 3A, there is shown a cross-sectional view of the switch of FIG. 2 taken along lines III—III and illustrating the switch in a first actuated position wherein the contact plate 22 is positioned to establish electrical communication between the first terminal 16 and the third terminal 20. Contact is established through the electrically conductive material of the contact plate 22 via the contact regions 24. And as illustrated, electrical communication between terminal 1, 16 and terminal 2, 20 is established through the electrically conductive contact plate 22.

Figure 3B:
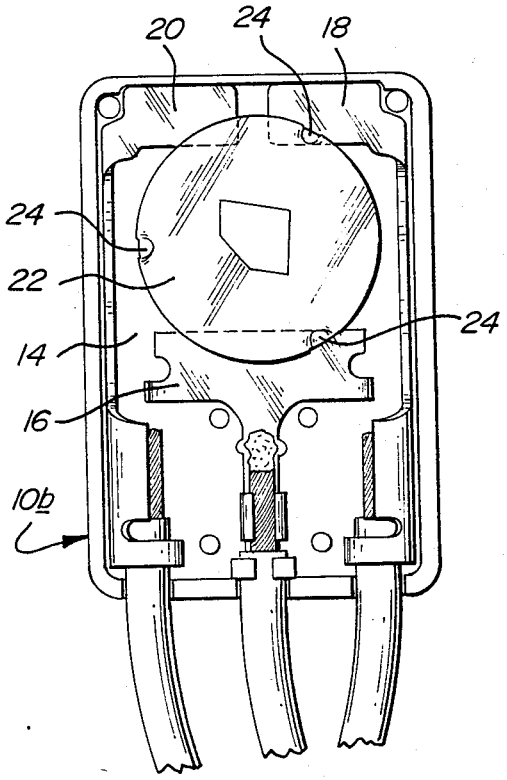
FIG. 3B is a sectional view of the switch of FIG. 2 taken along line III—III showing the contact plate in a second position.

Actuation of the stepping mechanism as previously described, rotates the contact plate and such rotation is illustrated in FIG. 3B, which is also a cross-sectional view of the switch of FIG. 2 taken along line III—III. As shown therein the contact plate 22 has been rotated through approximately 45° of travel and such rotation has caused the contact regions 24 thereof to establish electrical communication between the first terminal 16 and the second terminal 18. It should be noted that at all times during the operation of the switch the contact plate 22 is urged toward the electrical insulating surface 14 of the lower housing 1O*b* and/or the terminals 16, 18 and 20 by the spring. This operation is in contrast to more conventionally employed push-button switches in which an electrically conducting switch member is alternately raised and lowered from contact with one or more terminals and optionally rotated concommitant therewith. The fact that electrical contact in the switch of the present invention is established by sliding rather than lifting eliminates the problems of switch tease.

It should be apparent from FIGS. 3A and 3B in particular that the switch of the present invention may configured other than as illustrated herein. For example, the foregoing figures all show a three terminal switch in which actuation alternately establishes contact between a first and second and a first and third terminal. Obviously, one of the terminals may be eliminated and the switch may be simply operative to make and break electrical contact between a first and second electrical terminal. It should also be obvious that while the contact plate is generally illustrated as a circular member having a number of dimple-like projections proximate the circumferential periphery thereof, other configurations of contact plate may be similarly employed. For example, it may be expedient in some instances to configure the plate as a member having a number of radially projecting lobes extending from the center thereof, such lobes functioning as contact regions to establish electrical contact with a terminal. The plate 22 of the foregoing figures may be readily modified to such a lobed configuration by simply cutting notches into the periphery thereof in the regions between the contact dimples 24. It is further anticipated that other configurations of contact plate may be implemented. For example, the plate may be of an electrically conductive material with an insulating layer disposed everywhere thereupon except in the contact regions. These and other such modifications will be readily apparent to one of skill in the art in light of the teaching herein found; accordingly, it will be appreciated that the foregoing drawings, description and discussion are merely illustrative of particular embodiments of the present invention and are not limitations upon the practice thereof. It is the following claims, including all equivalents which define the scope of the invention.

We claim:

1. A tease-free switch comprising:

a housing including a base having a generally planar, electrically insulating interior surface;

a first and second electrical terminal of generally planar configuration disposed in mutually spaced apart relationship upon, and on parallel planes with, said electrically insulating surface;

a generally planar, disk-shaped contact plate fabricated from an electrically conductive material and including at least two circumferentially disposed contact regions thereupon, said contact regions disposed, when the plate is in a first position, to establish electrical communication between the first and second terminals and when the plate is in a second position, to not establish electrical communication between said first and second terminals, said contact plate including a non-circular opening defined in a central portion thereof, said plate disposed so as to be rotatable about an axis extending through and perpendicular to said opening, so that by rotation thereof said plate may be moved from said first position to said second position;

a push button having stepping means associated therewith, said stepping means including: a generally cylindrical plunger associated with the push button and having a plurality of circumferentially spaced lugs disposed thereabout; a camming stud including a generally disk-shaped member disposed in a spaced-apart parallel relationship with the plate and having a plurality of radially disposed camming ramps disposed thereupon, said camming stud further including a depending shaft projecting generally perpendicular to the disk-shaped member and having a non-circular cross section corresponding to and engaged with the non-circular opening in the plate, so that said camming stud and plate are operatively coupled to rotate together; said plunger and stud disposed in operative association so that upon displacement of the plunger in the direction of the stud, at least one of said lugs is operative to engage at least one of the camming ramps and incrementally rotate the camming stud and contact plate from said first position to said second position; and a spring interposed between the disk-shaped member of the camming stud and the contact plate, said spring operative to urge the plate into contact with the electrically insulating surface.

2. A switch as in claim 1,. further including a third generally planar electrical terminal disposed upon, and on parallel planes with the insulating surface and in spaced apart relationship with the first and second terminals; wherein said contact regions are operative, when the plate is in said second position, to establish electrical communication between said first terminal and said third terminal.

* * * * *